United States Patent [19]

Allan

[11] Patent Number: 4,827,684

[45] Date of Patent: May 9, 1989

[54] MASONRY VENEER WALL ANCHOR

[75] Inventor: Jack A. Allan, Palos Park, Ill.

[73] Assignee: AA Wire Products Company, Chicago, Ill.

[21] Appl. No.: 169,494

[22] Filed: Mar. 17, 1988

[51] Int. Cl.[4] ..... E04B 1/41

[52] U.S. Cl. ..... 52/378; 52/428; 52/573; 52/703; 52/714

[58] Field of Search ..... 52/712–715, 52/562, 563, 428, 378, 379, 703, 713, 714, 573

[56] References Cited

U.S. PATENT DOCUMENTS

| | | | |
|---|---|---|---|
| 779,268 | 1/1905 | Elliott | 52/428 |
| 1,013,038 | 12/1911 | Mitchell | 52/564 |
| 1,901,424 | 3/1933 | Wiley | 52/573 |
| 2,183,712 | 12/1939 | Dunlap | 52/379 |
| 3,277,626 | 10/1966 | Brynjolfsson et al. | 52/379 |
| 4,021,990 | 5/1977 | Schwalberg | 52/714 |
| 4,373,314 | 2/1983 | Allan . | |

*Primary Examiner*—James L. Ridgill, Jr.

*Attorney, Agent, or Firm*—Hill, Van Santen, Steadman & Simpson

[57] ABSTRACT

A masonry veneer wall anchor formed on an integral metal form preformed an an L-shaped bar has one leg overlying a building frame member for attachment thereto and has a horizontally disposed outstanding leg with an elongated slotted hole through which a tying member formed as a closed rectangular-sized loop with longitudinal and transverse legs offset at a 90° angle so that one section of the transverse legs may be inserted for vertical adjustment, the tying member engaging the edges of the slot at the transverse legs to provide improved resistance to compressive as well as pulling forces, thereby maximizing functional effectiveness.

4 Claims, 1 Drawing Sheet

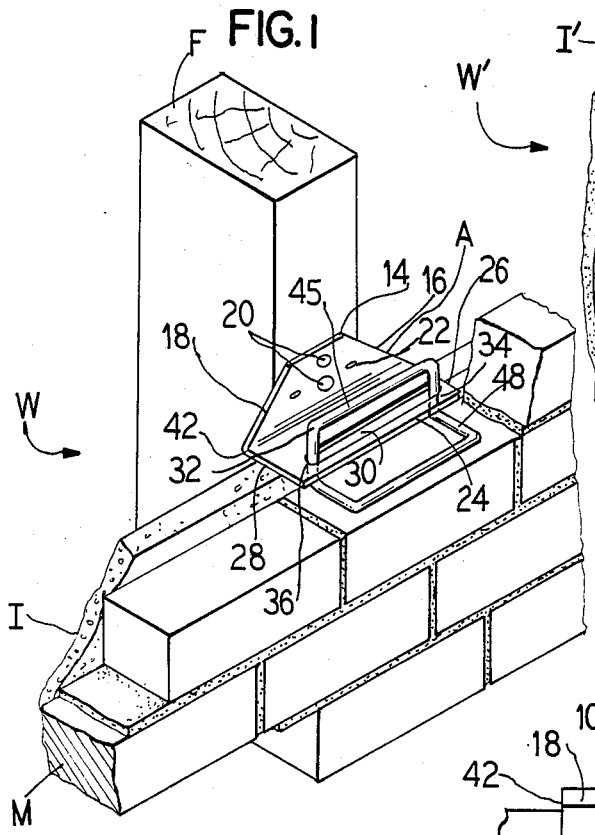
FIG. 1
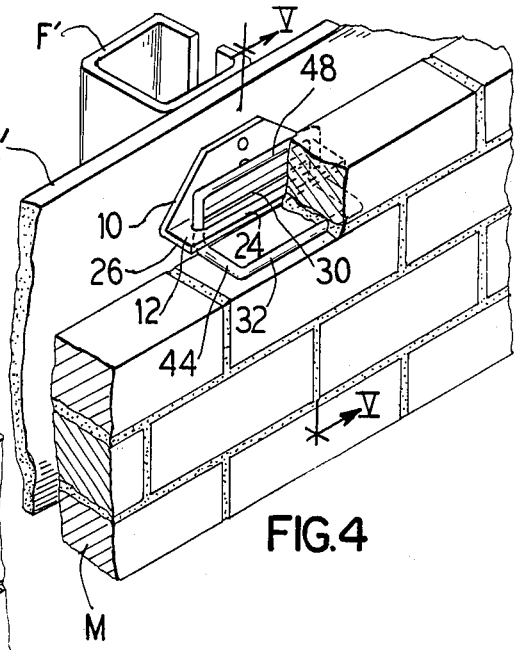
FIG. 4
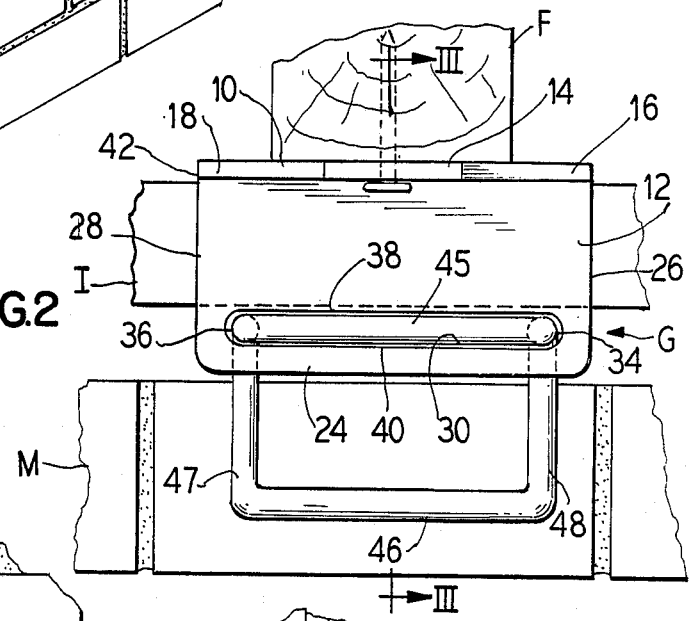
FIG. 2
FIG. 3
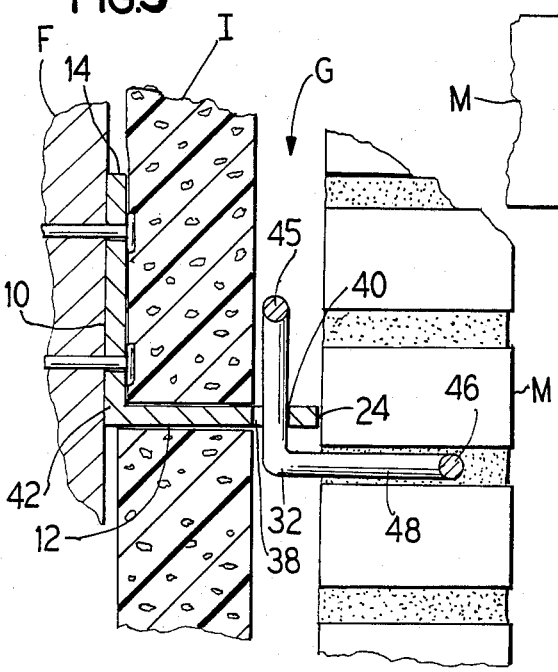
FIG. 5
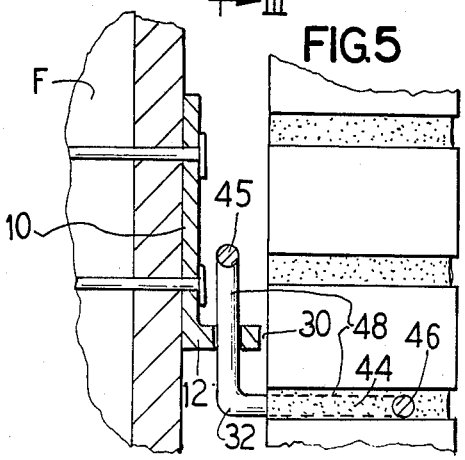

MASONRY VENEER WALL ANCHOR

BACKGROUND OF THE INVENTION

1. Field of the Invention

This invention relates to an anchor for tying a masonry veneer wall to the framing of an architectural structure.

2. Description of the Prior Art

With modern construction techniques, it is a common practice to enclose the framing of a building with a masonry veneer wall.

Many architects and engineers firmly believe that masonry veneer wall cracking would be reduced to a minimum if walls were permitted more freedom of movement. Accordingly, systems have been heretofore designed to provide lateral restraint of a masonry veneer wall while permitting horizontal and vertical movement.

In one form of such system, heretofore manufactured and sold by the applicant's assignee, AA Wire Products Company of Chicago, Ill., a flexible tie for tying masonry veneer walls to concrete or to steel is provided which is sold under the trademark "DOVETAIL FLEX-O-LOK" (to concrete) and "FLEX-O-LOK" (to steel). Examples of such ties include a masonry veneer wall laterally tied to concrete or steel columns, or masonry veneer walls laterally tied to concrete or steel beams, or precast concrete panels or stone laterally tied to poured concrete or steel back-up. In such an arrangement, a wire form or flat steel form of anchor is fastened either to an intervening flat plate or directly to an architectural structure as a matter of customer choice, whereupon a tying member adjustably moves relative to the anchor and is inserted between courses of the adjoining masonry veneer wall, thereby to permit the desired flexibility.

Another such system manufactured and sold by AA Wire Products Company is disclosed in applicant's U.S. Pat. No. 4,373,314, issued Feb. 15, 1983. This patent discloses an anchor formed of an integral metal form which is preformed as an L-shaped bar such as an angle iron. An outstanding leg of the anchor is vertically disposed and has one or more slotted holes formed therein in a selected spaced relation depending on the end use. The leg overlying the building frame member is provided with holes through which fasteners, such as screws or nails, are inserted for securing the anchor to either metal or wood studs.

The depth of the outstanding leg and the spacing of the slotted openings is selectively varied to allow a desired thickness of insulating material to be placed in the gap between the building frame member and the masonry veneer wall. The relative thinness of the outstanding anchor leg allows adjacent pieces of insulating material to be placed within close proximity of one another, thus minimizing energy-losing holes in the insulation.

A wire tie is inserted through one of the slotted holes in the anchor and is vertically adjustable within the vertically disposed slots. A portion of the tie is embedded in a horizontal masonry joint of the masonry veneer wall. The wire may bear against the perimeter of the slotted hole.

The prior art is also exemplified by U.S. Pat. No. 4,021,990 issued May 10, 1977 wherein a masonry veneer wall anchor comprises a plate member having a vertically projecting bar portion secured thereto and disposed in substantially parallel relationship with the plate member. The anchor is employed to secure a wallboard to a vertical channel or standard framing member. Thereafter, a mason inserts a wall tie between the plate member and projecting bar portion and the wall tie is built into the outer wythe of the wall system. Since the wall tie is capable of vertical movement, vertical adjustability is effected.

To ensure structural stability and to resist lateral pressure, such as that resulting from wind forces, it is necessary to tie the masonry veneer wall to the framing. Furthermore, it is often desirable to maintain a gap between the framing and masonry veneer wall for ventilation and drainage purposes or to accommodate a layer of insulating material.

SUMMARY OF THE INVENTION

According to the present invention, an anchor is formed of an integral metal form which is preformed as an L-shaped bar such as an angle iron so that an outstanding leg of the anchor may be disposed in the horizontal position. A slotted hole formed in the outstanding leg is also disposed to extend horizontally. The other leg of the anchor overlying the building frame member is provided with holes through which fasteners, such as screws or nails, are inserted for securing the anchor to either metal or wood studs.

The depth of the outstanding leg and the spacing of the slotted opening is selectively varied to allow a desired thickness of drywall or insulating material to be placed in the gap between the building frame member and the veneer wall. The relative thinness of the outstanding anchor leg allows adjacent pieces of plasterboard (drywall) or insulating material to be placed within close proximity of one another, thus minimizing energy-losing holes in the insulation.

Further, the leg of the anchor overlying the building frame member is made with a large surface area to prevent damage to the drywall or insulating material when it is mounted such that the drywall or insulating material is interposed between the anchor and building frame member. Therefore, the anchor can be anchored to the building frame member through the drywall or insulating material without damaging it. That is to say, the anchor is fastened to the building frame member but a sheet of drywall or insulating material is placed between the anchor and the building frame member.

In accordance with this invention, a closed rectangular loop having a length dimension just slightly less than that of the slot is bent medially at right angles to form an L-shaped wire tie. Such tie is inserted into the slotted hole in the anchor and is adjustable to be embedded in a horizontal masonry joint, but substantially only in the vertical direction. The opposite parallel legs of the tie bear against the respective ends of the slotted hole. By virtue of such provision the present invention provides improved resistance to compressive as well as axial forces, thereby maximizing its functional effectiveness.

BRIEF DESCRIPTION OF THE DRAWINGS

FIG. 1 is a fragmentary perspective view of a masonry veneer wall construction incorporating a wall with insulation and embodying the principles of the invnetion;

FIG. 2 is a top plan view of the masonry veneer wall construction of FIG. 1;

FIG. 3 is a vertical sectional view taken along the line III—III of FIG. 2;

FIG. 4 is a fragmentary perspective view of a masonry veneer wall construction incorporating a wall with drywall backing and embodying the principles of the invention; and FIG. 5 is a vertical sectional view taken along the line V—V of FIG. 4.

DESCRIPTION OF THE PREFERRED EMBODIMENT

In FIGS. 1-3, there is shown an insulated wall construction W which comprises a masonry veneer wall M, building frame member F, and an insulation layer or plasterboard sheet I. Plasterboard is also commonly referred to as drywall and the terms are used interchangeably herein. A wall anchoring means A embodying principles of the present invention is included for tying or fixing the masonry veneer wall M to the building frame member F.

According to the invention, the anchoring means A comprises a metallic member shaped as a prefabricated L-shaped metal form with an anchoring leg 10 and an outstanding leg 12 which are perpendicularly offset with respect to one another. Thus, the anchoring means A is comparable to an angle iron.

The anchoring leg 10 includes a horizontally disposed top edge 14 and angled edges 16 and 18. The anchoring leg 10 is intended to be fastened to a corresponding building frame member, whether that building frame member be made of wood, such as the building frame member F, or of steel or concrete. In order to affix the anchoring leg 10 to an adjoining surface of the corresponding building frame member there is provided a pair of vertically aligned, spaced apart through holes 20 centrally located on the anchoring leg 10. A pair of horizontally aligned, spaced apart through holes 22 are provided for affixing the anchoring means A to the corresponding building frame member in a rotated position to provided anchoring means similar to that disclosed in applicant's prior U.S. Pat. No. 4,373,314.

The outstanding leg 12 includes a longitudinal edge 24 and opposite end edges 26 and 28. An elongated slot or opening 30 is provided in the outstanding leg 12 to accommodate a tie, such as the triangular tie of my prior patent, in accordance with this invention. The slot or opening 30 is located inwardly of the longitudinal edge 24 and is bounded longitudinally by ends 34 and 36 and laterally by sides 38 and 40. The ends 34 and 36 are located inwardly of the edges 26 and 28.

According to the present invention, the width of the outstanding leg 12 may be varied so that the anchoring means A can be provided in different sizes for different applications. Thus, the length of the outstanding leg 12 between corner joint 42 and the side 38 of the elongated slot or opening 30 may be varied to accommodate varying thicknesses of the insulation layer or plasterboard sheet I. As an example of how the width of the outstanding leg 12 may be selected to accommodate various thicknesses of the insulation layer or plasterboard I, it is noted that to accommodate a one inch (25.4 mm) thick insulation layer or plasterboard sheet, the dimension between the corner joint 42 and the side 38 of the elongated slot or opening 30 may be set at 1⅛ inch (28.6 mm). To accommodate a two inch (50.8 mm) thick insulation layer or plasterboard sheet, the dimension may be set at 2⅛ inch (54.0 mm).

Regarding the insulation layers or plasterboard sheets I interposed between the masonry veneer wall M and the building frame member F, the insulation layers or plasterboard sheets may be brought together, one on top of another, so that they are separated only by the thickness of the outstanding leg 12 of the anchor A. If the edges of the insulation layer or plasterboard sheets are notched to fit around the outstanding leg 12, the insulation layers or plasterboard sheets I may be abutted. Moreover, slots may be cut into the insulation layers or plasterboard sheets I through which the outstanding leg is inserted. With any of these approaches, minimal energy losing air gaps in the insulation may be achieved.

In order to effect flexible anchoring and wall clamping of the masonry veneer wall M to the building frame member F, the tie 32 of the present invention is provided. The tie 32 comprises a square or rectangular-shaped closed loop of galvanized wire having longitudinal legs 45 and 46 and transverse legs 47 and 48. The transverse legs are medially bent at right angles so that the tie assumes an L-shaped profile shown in FIGS. 4 and 5. The tie may be made of wire of various sizes, for example 3/16 inch mill galvanized wire gauge or 6 to 9 gauge wire.

The tie 32 has horizontally disposed legs 45 and 46 which are of a length slightly less than the length of the slot 30. Thus, the transverse legs 47 and 48 will engage and abut the corresponding ends 36 and 34 of the slot 30. The upstanding section of the transverse legs 47 and 48 are inserted through the slot or opening 30 to fasten the masonry veneer wall M to the anchoring means A, thus fastening the masonry veneer wall M to the building frame member F. Additionally, the upstanding section of the legs 47 and 48 serve to confine the insulation layer or plasterboard sheet I and maintain an air gap G between the masonry veneer wall M and the insulation layer or plasterboard sheet I more or less equal to the dimension between the side 40 of the outstanding leg 12 and the longitudinal edge 24.

Shown in FIGS. 4 and 5 is another wall construction W′ in which a plasterboard I′ is interposed between the anchoring means A and a building frame member F′. In this construction, the anchoring means A is fastened to the building frame member F′ through the plasterboard I′.

It is most clearly shown in FIG. 5 that, because the anchor means A is located on the masonry veneer wall side of the plasterboard I′, the dimension between the corner joint 42 and the side 38 of the slot or opening 30 is made very short as no insulation layer or plasterboard need be accommodated. Similarly, should no plasterboard I′ be used at all, the shortened anchoring means A may be used to fasten the masonry veneer M directly to the building frame F′.

It is noted that the surface area of the anchoring leg 10 of the anchoring means A is large enough to prevent damage to the plasterboard I′ when the wall construction W′ shown in FIGS. 4 and 5 is employed. Thus, the plasterboard I′ may be interposed between the building frame member F′ and the anchoring means A without concern as to whether the anchoring means A will dig into the plasterboard I′ and thus, mar its surface.

Although modifications might be suggested by those skilled in the art, it will be understood that I wish to embody within the scope of the patent described herein all such modifications as reasonably and properly come within the scope of my contribution to the art.

I claim as my invention:

1. For use in a masonry wall veneer tie construction, a unitary wall anchor, comprising:

first and second integrated leg components of coextensive length, each leg component having ends spaced apart from one another in the direction of a horizontal axis, each leg component having a first longitudinal edge which is common to both thereby to form a corner joint, each leg component having a second longitudinal edge which is spaced from said first edge and disposed in respective offset planes intersecting at said corner joint, said first leg component having means for fastening said anchor with said first leg component in overlying relation to an adjoining architectural member, said first leg component having a surface area large enough to prevent damage to a drywall when fastened thereon, said second leg component being rectangularly shaped and having an elongated slot formed therein inwardly of its edges and bounded longitudinally by ends and bounded laterally by inner and outer sides extending in parallelism to said horizontal axis, said slot being sized to receive a tie means inserted therein, the slot engaging the tie means for transmitting both pulling and pushing forces to the adjoining architectural member over the entire area of said overlying first leg component; and a tie means for insertion into said slot comprising a rectangular closed wire loop having spaced longitudinal parallel legs and spaced parallel transverse legs, said longitudinal legs of said tie means having a spacing dimension slightly less than the spacing dimension between said ends of said elongated slot, said transverse legs of said tie means being medially bent at an offset plane with respect to one another whereby the upstanding section of said transverse legs of said tie means can be inserted into said slot for vertical sliding adjustment, said transverse legs of said tie means being abuttingly engageable with said ends of said slot.

2. The invention as defined in claim 1 wherein said offset planes are disposed in a 90° offset relation with respect to one another and said offset plane of said transverse legs having a right angle.

3. Anchor means for anchoring a masonry wall veneer to a building frame member, comprising:

an angled anchor having upstanding and outstanding leg components having a common horizontal edge and which are disposed at a right angle to each other, said upstanding leg being disposed vertically and including means for fastening said upstanding leg in overlying relation to the building frame member, said outstanding leg being disposed horizontally and including an elongated horizontal slot formed therein which runs parallel to said common horizontal edge, said horizontal slot being spaced a predetermined amount from said common horizontal edge to thereby accommodate a specific width of a drywall panel therebetween; and tie means for securing said masonry wall veneer to said angled anchor comprising a closed loop with longitudinal and transverse legs and being offset to form an angled loop with horizontally disposed and vertically disposed sections, said vertically disposed section being of a dimension size accommodating a sliding fit insertion through said elongated slot of said angled anchor, said horizontally disposed section being securable within the masonry wall veneer, said tie means being vertically adjustable within said elongated slot, but abuttingly engaging the transverse legs against the ends of said slot.

4. Anchor means as set forth in claim 3, wherein said tie means more specifically comprises a square-shaped loop of wire bent to form a rectangularly-shaped vertically disposed section and a rectangularly-shaped horizontally disposed section.

* * * * *